US005407242A

United States Patent [19]

Beranek

[11] Patent Number: 5,407,242

[45] Date of Patent: Apr. 18, 1995

[54] TENNIS BALL RETRIEVER

[76] Inventor: Kurt G. Beranek, 1744 E. Ridgewood, Glenview, Ill. 60025

[21] Appl. No.: 239,746

[22] Filed: May 9, 1994

[51] Int. Cl.[6] ..... A63B 47/02

[52] U.S. Cl. ..... 294/19.2; 414/440

[58] Field of Search ..... 294/19.2; 56/327.1, 56/328.1, 332, 400.01–400.03; 171/58, 63; 414/437, 439, 440

[56] References Cited

U.S. PATENT DOCUMENTS

| | | | |
|---|---|---|---|
| 2,413,679 | 1/1947 | Binder | 414/440 |
| 2,651,902 | 9/1953 | Curry | 414/440 X |
| 2,718,745 | 9/1955 | Scafidi | 294/19.2 X |
| 3,068,634 | 12/1962 | Robinson | 294/19.2 X |
| 3,215,293 | 11/1965 | Kelly et al. | 294/19.2 X |
| 3,227,298 | 1/1966 | Shoemaker | 294/19.2 X |
| 3,804,449 | 4/1974 | Falitz | 294/19.2 |
| 3,902,749 | 9/1975 | Falitz | 294/19.2 |
| 3,926,465 | 12/1975 | Hoagland et al. | 294/19.2 |
| 4,310,189 | 1/1982 | Nihra | 294/19.2 |
| 4,318,654 | 3/1982 | Lee | 294/19.2 X |
| 4,645,254 | 2/1987 | Warden | 294/19.2 |
| 5,152,565 | 10/1992 | Dodd | 294/19.2 |

FOREIGN PATENT DOCUMENTS

| | | | |
|---|---|---|---|
| 2481128 | 10/1981 | France | 294/19.2 |
| 2574670 | 6/1986 | France | 294/19.2 |
| 3921915 | 1/1991 | Germany | 294/19.2 |
| 3934490 | 4/1991 | Germany | 414/437 |
| 1388 | of 1903 | United Kingdom | 294/19.2 |
| 3628 | 1/1903 | United Kingdom | 294/19.2 |

*Primary Examiner*—Johnny D. Cherry
*Attorney, Agent, or Firm*—Leydig, Voit & Mayer, Ltd.

[57] ABSTRACT

A tennis ball retriever and its method of use are disclosed. The tennis ball retriever includes a handle and a collection drum rotatably journalized on the handle. The cylindrical drum is provided with a plurality of axially spaced circumferential tines. At least one of the tines of each spaced-apart pair includes an abrasive surface. In the preferred embodiment, the two outermost circumferential tines have a larger diameter than the inner tines and the outer tines are provided with an outer rolling, supporting and preferably gripping surface. A hinged access door is provided at one end of the collection drum for removing the tennis balls collected within the drum. In use, a person holds the handle grips and rolls the collection drum over loose tennis balls lying on a tennis court or practice surface. The loose tennis balls are grasped by the abrasive surfaces of the spaced-apart cylindrical tines and urged into the interior of the collection drum. The hinged door may be unlatched to remove the tennis balls from the drum interior.

12 Claims, 7 Drawing Sheets

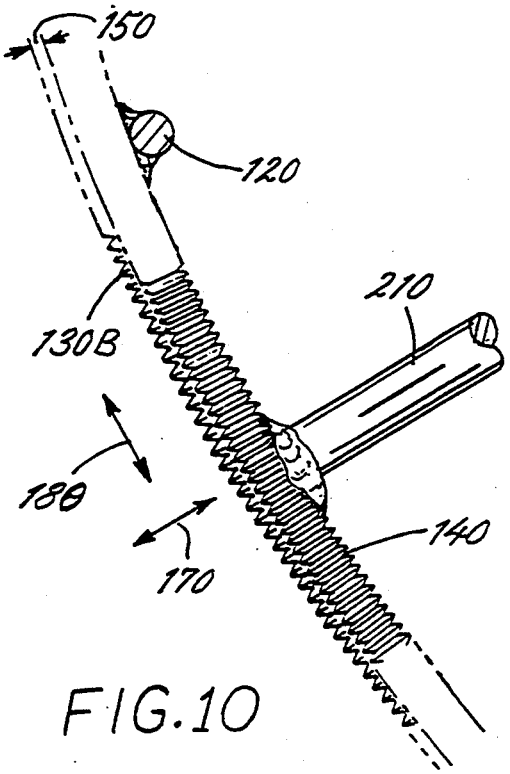
FIG.10
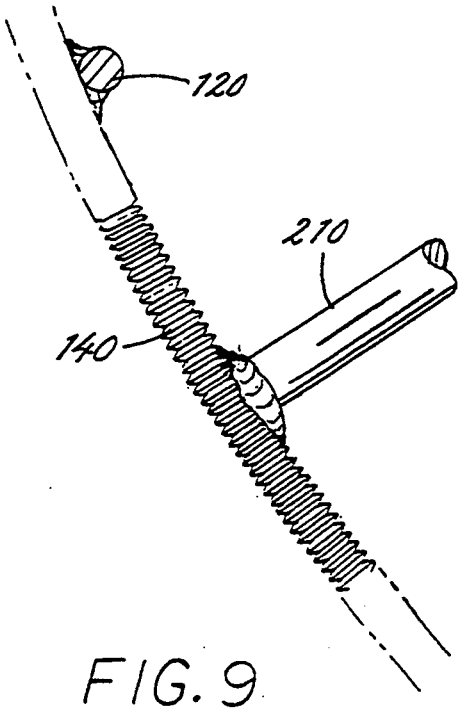
FIG. 9
FIG.12
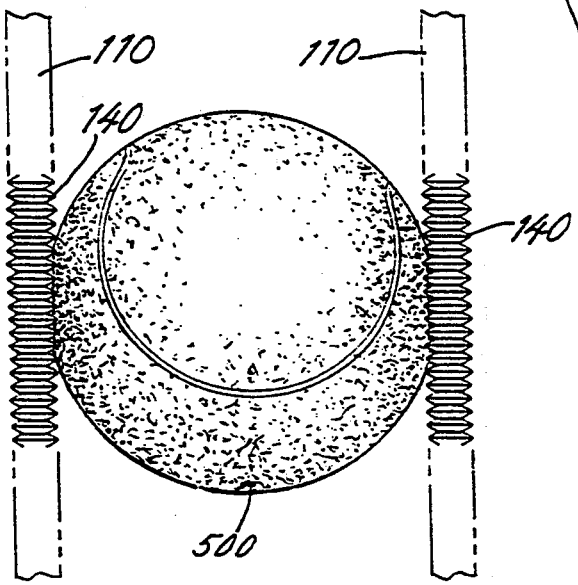
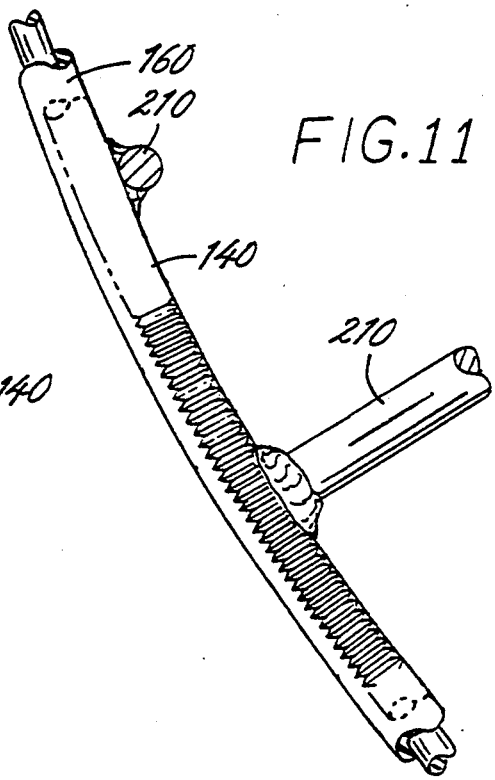
FIG.11

TENNIS BALL RETRIEVER

TECHNICAL FIELD OF THE INVENTION

The present invention relates generally to devices and methods for collecting and retrieving round, resilient objects. More specifically, the present invention is directed toward a device and method for collecting and retrieving tennis balls from a tennis court.

BACKGROUND OF THE INVENTION

Tennis is an extremely popular sport, both in the United States and in other countries throughout the world. As a recreational sport, tennis has always been very popular with adults and children of all ages. Moreover, in recent years, tennis has emerged as a widely followed professional sport as well, with several major tournaments televised each year.

As an amateur sport, tennis is popular for a number of reasons. For example, tennis is an all-season sport. It may be played indoors at any time, and may be played outdoors in suitable weather. Because tennis is a nonviolent, noncontact sport, tennis appeals to parents who are hesitant to involve their children in sports such as football or hockey. Those interested in the game of tennis can participate for a minimal cost, by, for example, making use of the facilities available at public parks. In addition, tennis lessons are widely available, at beginning, intermediate, and advanced levels.

Tennis players at all levels typically practice by repeatedly performing the same action, such as a serve or forehand shot. In some instances, an instructor will serve the tennis balls to the student, who will then attempt to return the ball. In other cases, a tennis player will practice with the aid of an automated tennis ball serving machine. Such a machine is particularly useful for tennis instruction at all levels. For example, it allows a tennis player to practice without the aid of an instructor. In addition, if the machine is used during a tennis lesson, the instructor may monitor the progress of the students from a few feet away, rather than having to serve the balls from across the court.

Of course, in any tennis lesson or practice session, a large number of tennis balls will be used. In particular, when a tennis ball serving machine is used, as many as several hundred tennis balls may be served during the course of a single lesson or session. All of these tennis balls must be retrieved from the tennis court during and at the end of the lesson or session.

Because of the difficulty and inconvenience of bending down to pick up each tennis ball individually, tennis players typically use a tennis ball retrieving device to gather the tennis balls. A number of such tennis ball retrieving devices have been developed to date. For example, one commonly used device comprises a tube having an opening slightly smaller than the diameter of a tennis ball. To collect tennis balls, the user presses down individually on each ball with the tube, causing the ball to compress slightly and squeeze into the tube. Other conventional tennis ball retrieving devices include baskets and similar apparatuses made of wire mesh, having mesh openings slightly smaller than that of a tennis ball. These devices allow the user to pick up two or three tennis balls in a single pass.

Conventional tennis ball retrieving devices suffer from a number of drawbacks. The most significant disadvantage is the substantial amount of time required to retrieve a large number of tennis balls using such devices, especially when an automated tennis ball server is used. A second disadvantage of such conventional devices, particularly the basket-type devices, is that they become heavy as they become filled with tennis balls. Because the user must pick up the apparatus each time he or she moves it to the next tennis ball, a significant possibility of shoulder or back injury arises with the use of such devices. Although tennis ball retrievers including a rolling barrel have been designed in an attempt to overcome these shortcomings, these devices have been observed to be ineffective in retrieving tennis balls, inasmuch as they tend to push the tennis balls away rather than retrieve the tennis balls. The present invention seeks to provide tennis ball retrievers and associated methods that overcome these drawbacks.

BRIEF SUMMARY OF THE INVENTION

The present invention provides a tennis ball retriever comprising a handle and a collection drum rotatably journalled on the handle. The collection drum is made of a plurality of axially spaced circumferential tines, and at least one of the tines of each spaced-apart pair includes an abrasive surface. Preferably, the abrasive surface is a plurality of grooves. A hinged door latched to one end of the collection drum may be unlatched and opened to remove the tennis balls from the drum interior.

In addition, the present invention provides a method of retrieving tennis balls from a tennis court using the tennis ball retriever of the present invention. The method comprises guiding the collection drum of the tennis ball retriever to a position in which the tennis balls are substantially centered between any two adjacent tines, and causing the tennis balls to be urged into the collection drum.

BRIEF DESCRIPTION OF THE DRAWINGS

FIGS. 9 and 10 are greatly enlarged, partial cross-sectional views of the tennis ball retriever illustrated in FIG. 7 substantially as seen along lines 9—9 and 10—10 in FIG. 7, respectively;

FIG. 11 is a view similar to FIG. 10 of a second embodiment of the tennis ball retriever according to the present invention;

FIG. 12 is an enlarged, partial cross-sectional view taken from within the collection drum of the tennis ball retriever of FIG. 1 as a tennis ball is urged into the tennis ball retriever.

DESCRIPTION OF THE PREFERRED EMBODIMENTS

Figure 1:
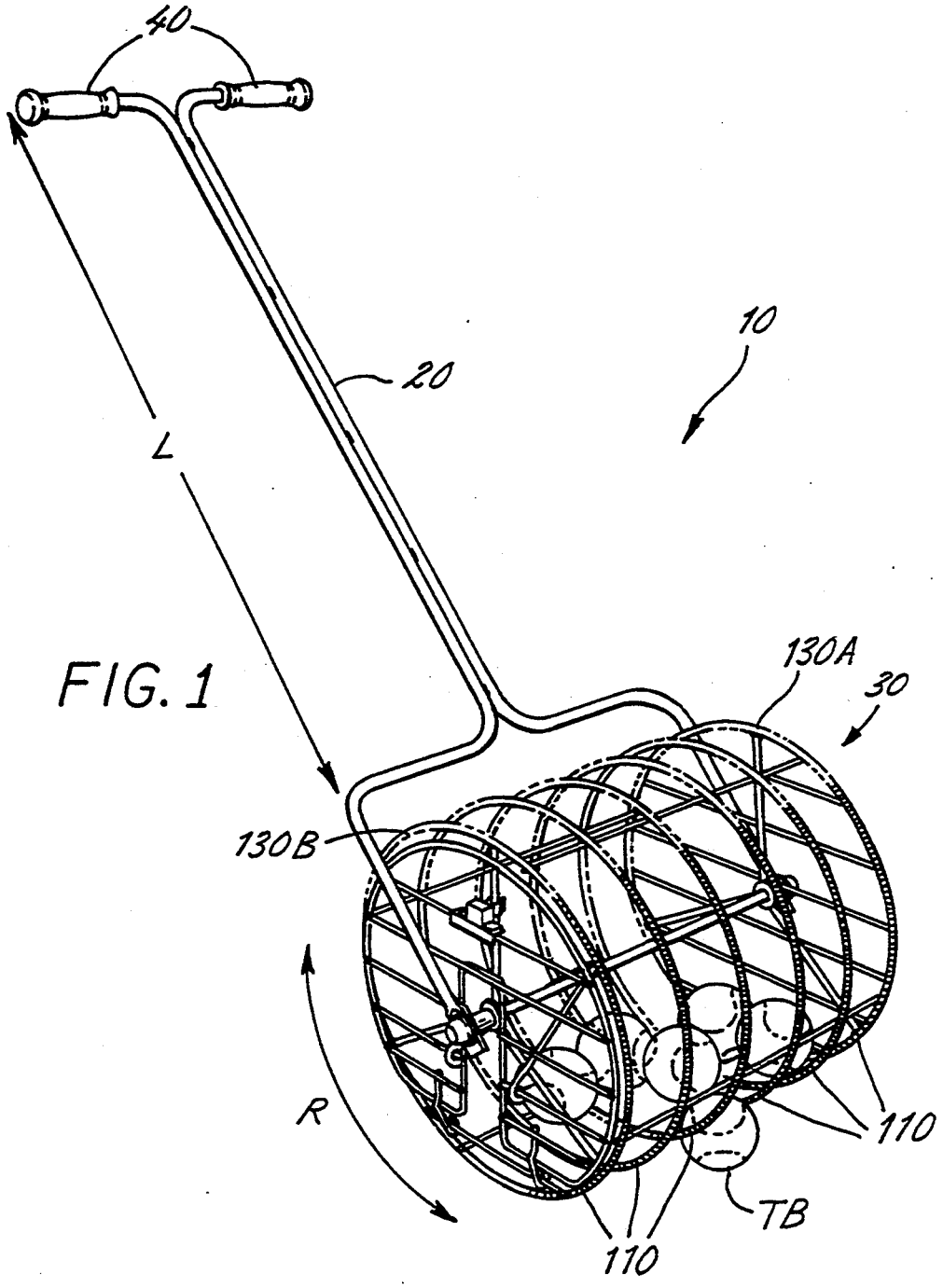
FIG. 1 is a perspective view of a tennis ball retriever according to the present invention, and of its use in retrieving tennis balls.

With reference to FIG. 1, a tennis ball retriever 10 comprises a handle 20 and a collection drum 30 rotatably journalled on the handle 20. The collection drum 30 may rotate in either direction, as illustrated in FIG. 1 by the arrow of rotation R.

Operation of the tennis ball retriever 10 is also illustrated in FIG. 1. A user (not shown), with the aid of the handle 20, pushes the collection drum 30 along the surface of a tennis court or other surface (not shown), thus causing the collection drum 30 to roll as it advances across the surface. The handle 20 has a length L suitable to allow a user to operate the tennis ball retriever 10 when standing or walking. Preferably, this length is approximately thirty inches. The user guides the collection drum to a tennis ball TB, which is urged into the collection drum 30 as the collection drum advances.

Figure 2:
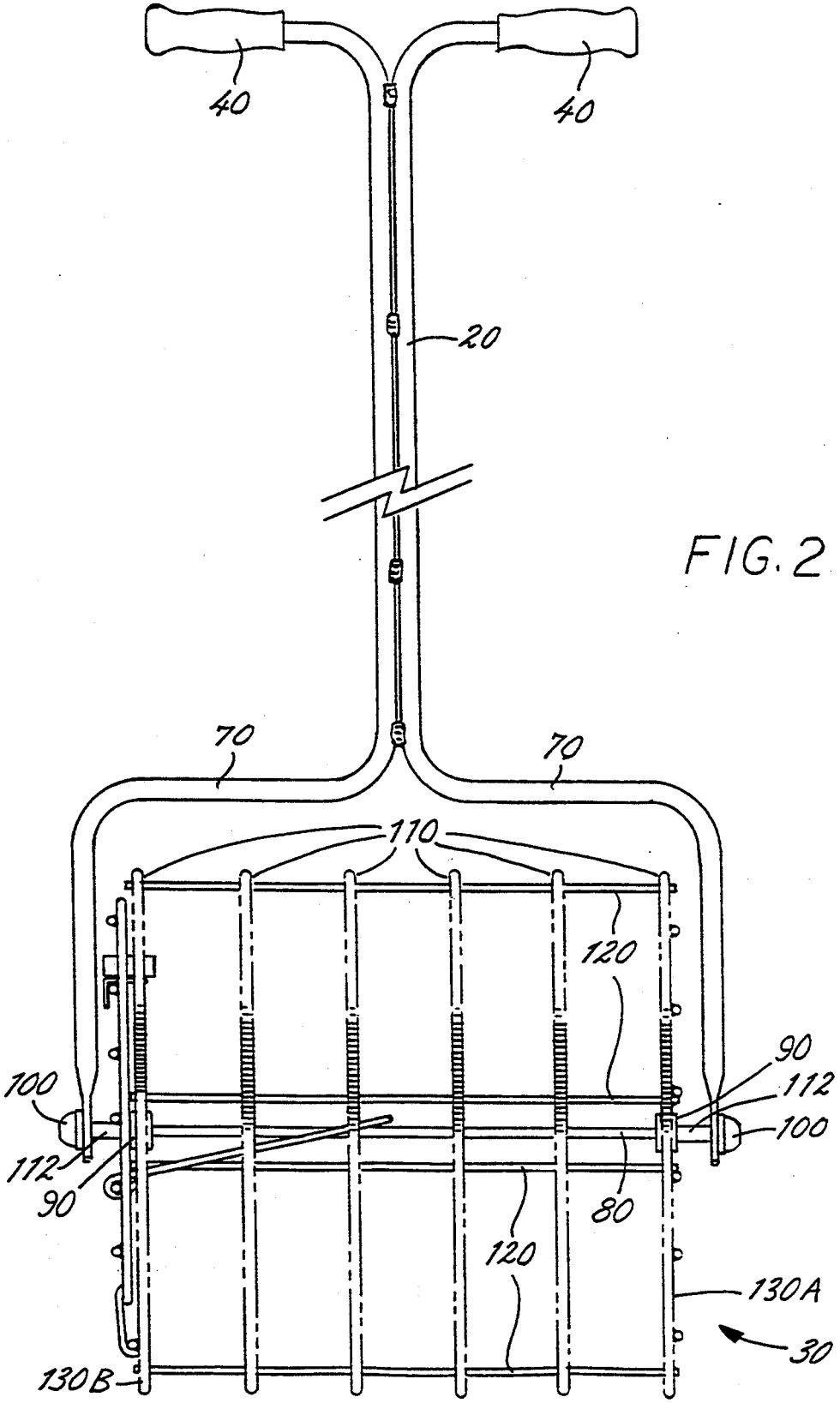
FIG. 2 is an enlarged, top plan view of the tennis ball retriever illustrated in FIG. 1, with a portion of the handle broken away.

The handle 20 may be constructed of any suitable material, such as metal, plastic, or a composite material. Preferably, the handle 20 is constructed from aluminum, and is anodized or coated with an enamel. In a preferred embodiment, the handle 20 includes one or more handgrips 40. The handgrips 40 are preferably plastic or foam rubber grips similar to bicycle grips. At its end opposite the handgrips 40, the handle is bifurcated into yoke-like drum supports 70, as is illustrated in FIG. 2.

Figure 13:
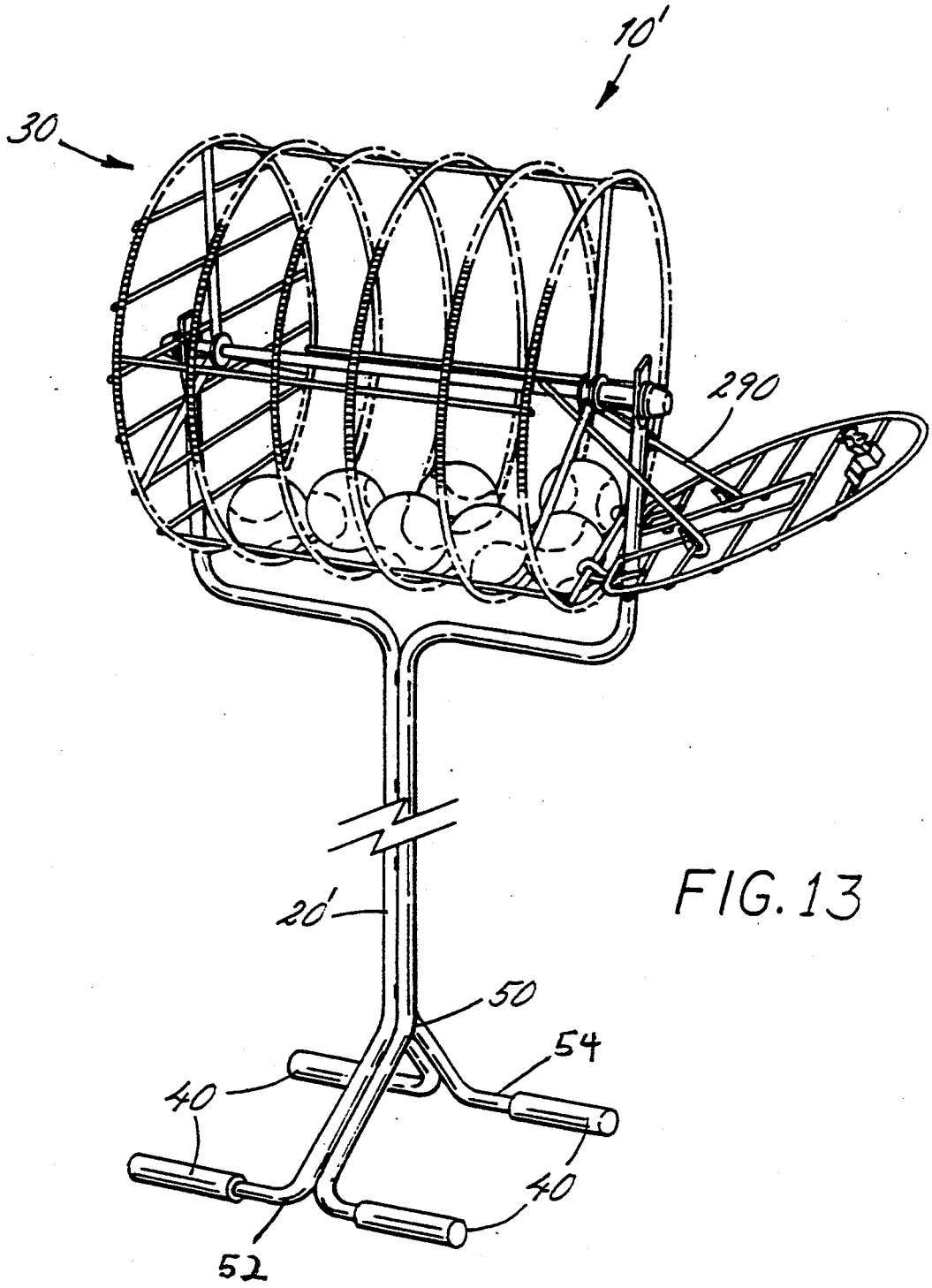
FIG. 13 is a perspective view of a third embodiment of the tennis ball retriever according to the present invention.

The structure illustrated in FIG. 1 is the preferred structure for the handle 20. Alternatively, as illustrated in FIG. 13, the handle 20′ may be constructed such that the tennis ball retriever 10′ may be inverted to rest on the handle 20′. For example, the handle may include a fork 50 to separate the handle into T-shaped sections 52, 54, or may be constructed in any other suitable manner. Such a construction is not required, and it will be understood that it is only necessary that the handle 20′ allow a user to operate the tennis ball retriever 10′ so as to cause the collection drum 30 to rotate over the surface on which loose tennis balls are located.

The collection drum 30 is journalled on the handle 20 so that it may freely rotate in either direction relative to the handle 20. Preferably, the collection drum 30 is journalled on an axle 80, as illustrated in FIG. 2. The axle 80 passes through bearings 90 attached to the collection drum 30, and terminates in hubs 100 on either end of the collection drum 30. Preferably, spacers 112 are included to keep the collection drum 30 centered between the yoke-like drum supports 70. The spacers 112 preferably are hollow cylindrical tubes, which may terminate at each end in a disc. The spacers 112, hubs 100, and axle 80 all are preferably made from aluminum, but may be made from any other suitable material.

The collection drum 30 is preferably cylindrical and is made from stainless steel that has been coated with zinc to enhance its appearance and resistance to corrosion. It will be understood, of course, that other materials are suitable, such as aluminum, plastic, composite materials, etc.

FIGS. 1, 2, 3, and 8 illustrate the preferred construction of the collection drum 30. As shown, the collection drum comprises a plurality of axially spaced-apart circumferential tines, generally designated 110. The tines 110 preferably are sufficiently rigid so that the tennis balls will compress as they are urged into the collection drum 30. The tines 110 may have any suitable cross-sectional shape, such as circular, pentagonal, hexagonal, etc., but are preferably circular. In the illustrated embodiment, the tines 110 comprise a plurality of axially spaced apart parallel rings, wherein each ring has a generally circular cross-sectional shape.

Figure 8:
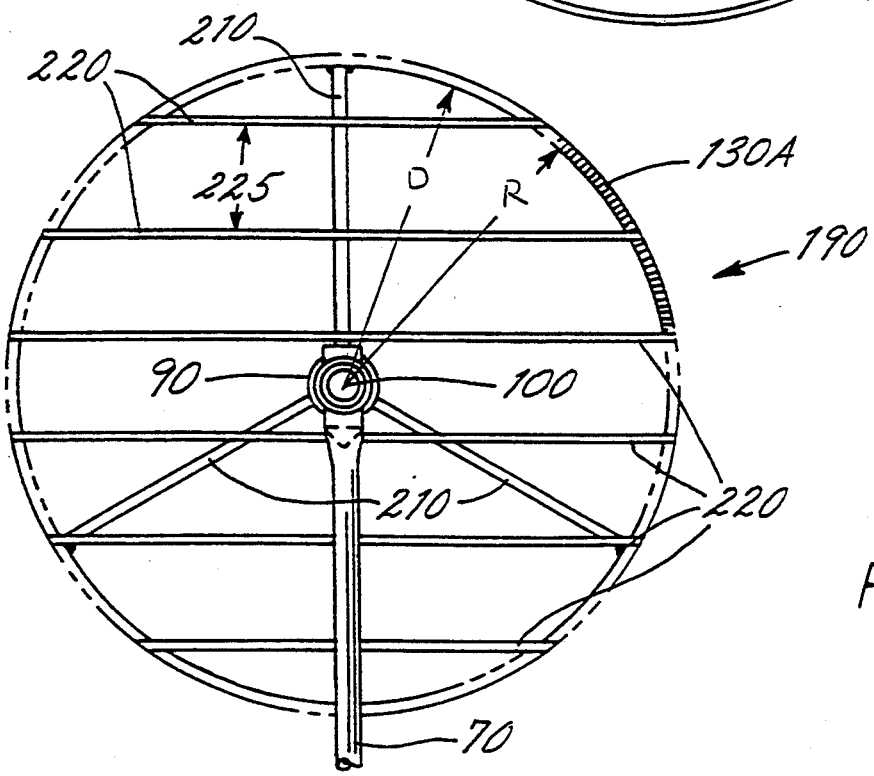
FIG. 8 is a left-hand side view of the tennis ball retriever illustrated in FIG. 1.

In the preferred embodiment, the tines include a pair of outer tines 130A, 130B and at least one inner tine 110. More preferably, a plurality of inner tines 110 are provided. In the illustrated embodiment, the tennis ball retriever 10 has a pair of outer tines 130A, 130B and four inner tines 110. As shown in FIG. 8, each inner tine 110 has an outer radius R and corresponding outer diameter equal to twice the outer radius, or 2R.

The collection drum 30 is constructed by placing each circumferential inner tine 110 in axially spaced-apart position substantially parallel to the other tines 110. The tines 110 are preferably axially spaced apart by 2.25 inches, although it is only required that the axial spacing be sufficiently large to allow the retriever 10 to retrieve tennis balls, and sufficiently small to retain the tennis balls within the drum 30 after collection. To keep the rings in the proper axially spaced-apart position, support rods 120 are used. The support rods 120 have a small diameter, preferably about 0.125 inches, so as to not interfere with the tennis ball retriever 10 in operation. This structure, of course, is by no means critical, and the collection drum 30 may be constructed in any other suitable manner.

In accordance with the present invention, the inner tines 110 include an abrasive surface to help grip and retain the tennis balls as they are captured by the tennis ball retriever 10. Preferably, all of the inner tines 110 include an abrasive surface at all points where the tines potentially contact the tennis balls. This abrasive surface provides a greater surface area of contact between the tennis balls and the tines 110, which also provides for greater friction between the tennis balls and the tines 110. Various types of abrasive surfaces may be used and may include a pitted or a raspy, sandpaper-like finish. The support rods 120, on the other hand, preferably do not have an abrasive surface, but rather may have a smooth surface.

In the preferred embodiment, the surface of the tines 110 includes a plurality of grooves 140, as illustrated in FIGS. 9–12. The tines 110 can thus be constructed from a threaded rod, such as a 0.25 inch threaded rod, formed into a circle. A 0.25 inch threaded rod is sufficiently rigid for causing the tennis balls to compress as they are urged into the collection drum 30. When the surface of the threaded rod includes such grooves 140, the tennis ball retriever 10 is particularly effective. As illustrated in FIG. 12, a tennis ball TB that comes within the space between the tines 110 is constrained by the grooves 140 to move in a radial direction which, in FIG. 12, is into and out of the page. More importantly, in accordance with the invention, the tennis ball is impeded by the grooves 140 from moving in a direction parallel to the tines 110. This allows the tines 110 to readily grasp and urge the tennis ball TB into the collection drum 30 as the drum advances.

The tennis ball need not be in the position illustrated in FIG. 12 for the grooves 140 to have this effect. Indeed, the grooves have a significant effect when the tennis ball is not so situated. Thus, when a tennis ball lies directly beneath a tine 110, the grooves inhibit the tennis ball from moving in any direction except radially into the collection drum 30 during the rotary advancement of the drum. The advancement of the collection drum 30 will thus drive the tennis ball into the position illustrated in FIG. 12, rather than pushing the tennis ball forwardly or laterally away from the tine 110. This greatly facilitates the retrieval of tennis balls, especially where a large number of tennis balls are being retrieved.

The outer diameter of the tines 110 may be in the range from about ten inches to about eighteen inches; and most preferably, is about twelve inches. The outer tines 130A, 130B may have the same outside diameter as that of the inner tines, or, alternatively, the outer tines may have a somewhat larger outer diameter. If the outer tines 130A, 130B have a larger outer diameter than the inner tines, the inner tines will not contact the surface of the tennis court or other surface when the tennis ball retriever 10 is used. In this case, the outer diameter of the outer tines 130A, 130B should be about 0.125 inches greater than the diameter of the inner tines 110. This preferred design prevents undue wear on the abrasive surface of the inner tines 110, and, in addition, mitigates the possibility that the tines 110 will cause damage to the tennis court or other surface.

The outer diameter of the outer tines 130A, 130B may be made larger than the outer diameter of the inner tines 110 in a variety of ways. For example, as illustrated in FIG. 10, the outer tine 130B may be fashioned from a threaded rod having a larger rod diameter than that of the inner tines; i.e., there is a diameter differential of distance 150 between the rods. In this instance, the inner diameter of the outer tine 130B is identical to the inner diameter of the inner tines. Alternatively, the outer tines 130A, 130B may be constructed from a longer length of threaded rod having the same rod diameter as that of the rod used to construct the inner tines. In this embodiment, the inner diameter of the outer tines 130A, 130B is greater than the inner diameter of the inner tines 110. Still another possibility is that the outer tine 130B includes a nonabrasive outer surface. For example, outer tine 130B may include a tire 160, as illustrated in FIG. 11. Other structures are possible; for example, the outer tines 130A, 130B may have a coating of rubber or other suitable material.

As illustrated, collection drum 30 has a generally cylindrical shape and the sides of the collection drum comprise first and second circular end faces 190, 200. FIGS. 3–8 illustrate the sides of the collection drum 30 when outer tine 130A is a threaded rod having the same inner and outer diameters as the inner tines. With reference to FIG. 8, the first circular end face 190 includes one or more generally radial support posts or spokes 210 connected to the bearing 90. To keep the tennis balls from escaping, the first circular end face 190 includes bars 220, which are preferably evenly spaced apart by a distance that is smaller than the diameter of a tennis ball. Preferably, this spacing is approximately 1.5 inches.

FIGS. 3–7 illustrate the second circular end face 200 of the collection drum 30. In the preferred embodiment, the second end face 200 includes a gate 230 for removal of tennis balls from within the collection drum 30. Preferably, the gate 230 comprises a truncated ring 240 hingeably mounted to the collection drum 30 between an open position and a closed position. The gate 230 also includes gate bars 250 connected to the truncated ring 240. The maximum distance between any two gate bars 250 should be an interval that will prevent the tennis balls from escaping from within the collection drum 30, preferably no more than about two inches.

Figure 3:
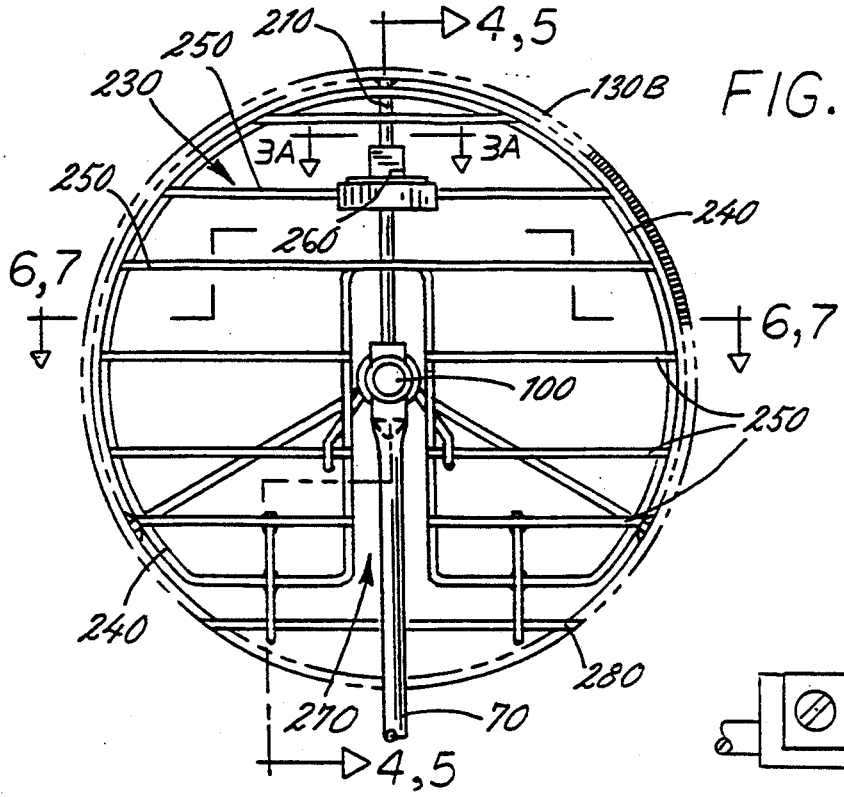
FIG. 3 is a right-hand side view of the tennis ball retriever illustrated in FIG. 1.
Figure 3A:
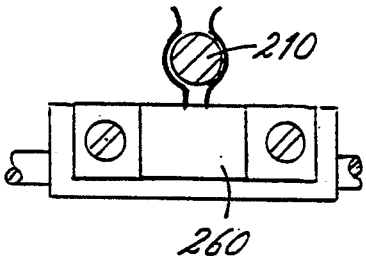
FIG. 3A is an enlarged, fragmentary sectional view of the door hinge, substantially as seen along line 3A—3A in FIG. 3.
Figure 4:
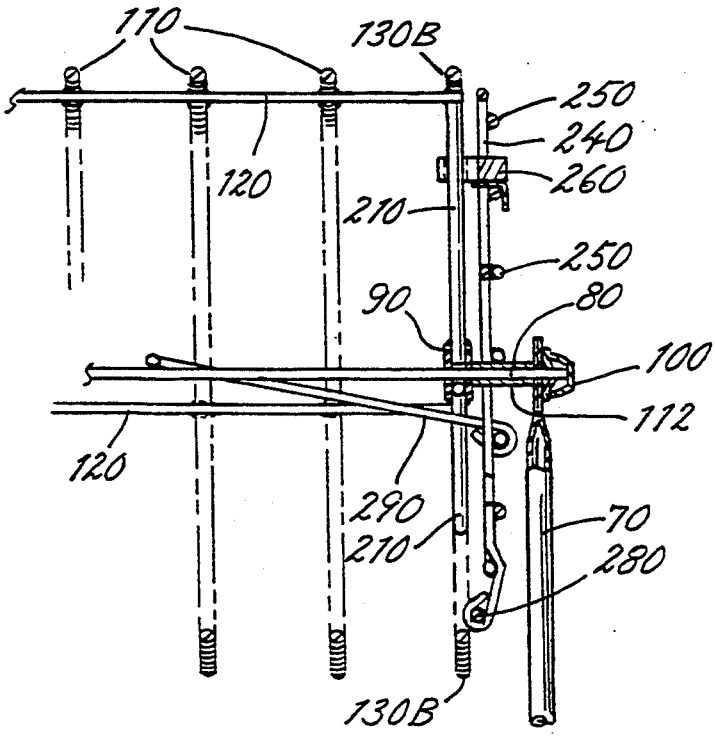
FIG. 4 is an enlarged, partial cross-sectional view of the tennis ball retriever substantially as seen along line 4—4 in FIG. 3, with the hinged access door closed.
Figure 5:
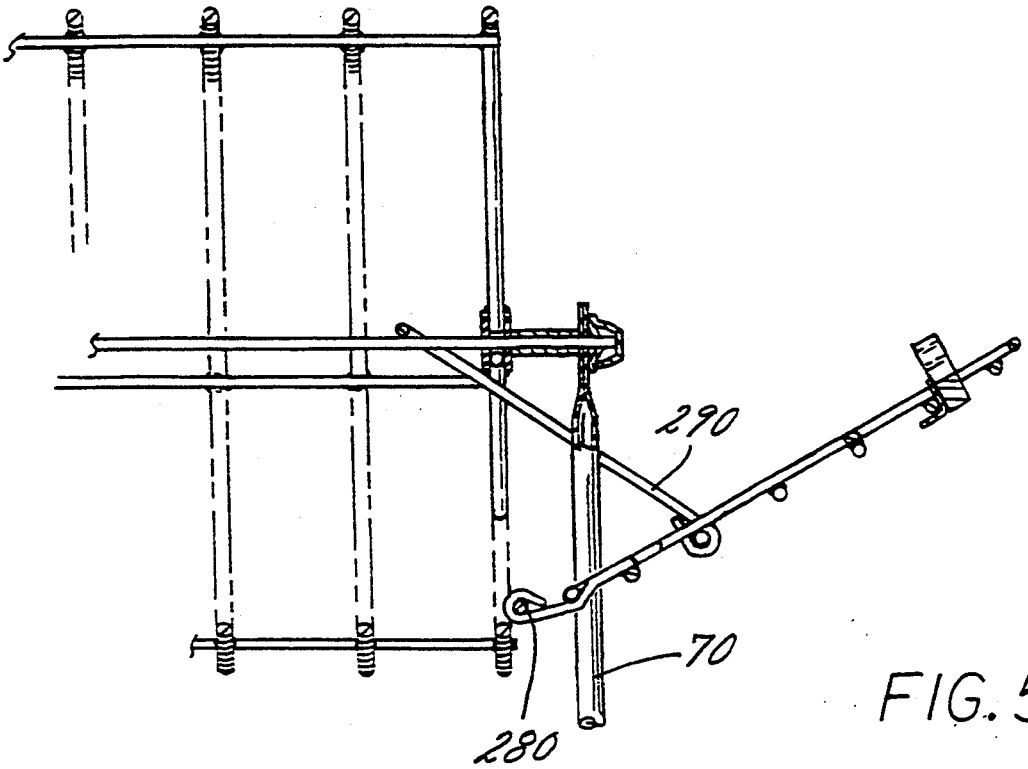
FIG. 5 is an enlarged, partial cross-sectional view of the tennis ball retriever substantially as seen along line 5—5 in FIG. 3, with the access door in an open position.
Figure 6:
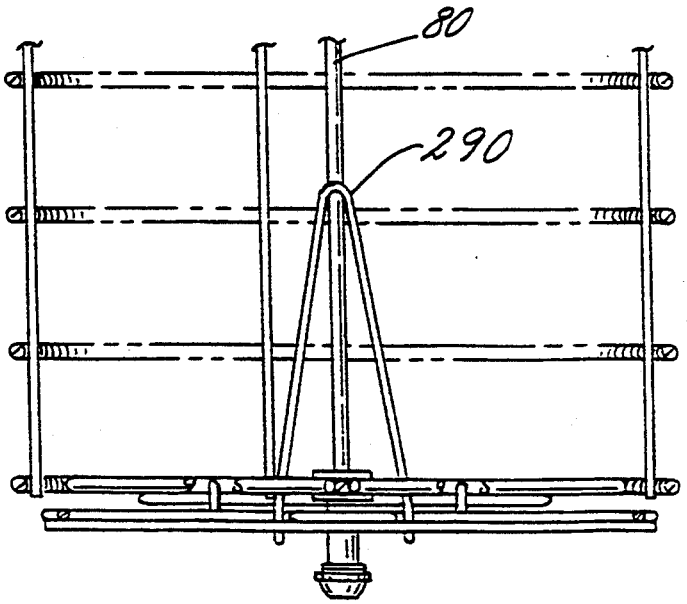
FIG. 6 is an enlarged, partial cross-sectional view of the tennis ball retriever substantially as seen along line 6—6 in FIG. 3, with the access door closed.

The gate 230 further includes a clasp 260, which allows the user to releasably lock the gate 30 into a closed position by fastening the gate 30 to a support post 210. Preferably, the clasp 260 is a commercially available cabinet-type fastener, as illustrated in FIG. 3A, which is fastened to a gate bar 250 by screws or other suitable means. The type of clasp is not critical to the operation of the tennis ball retriever 10, of course, and the clasp 260 may comprise a magnetic fastener or other suitable attaching means.

Figure 7:
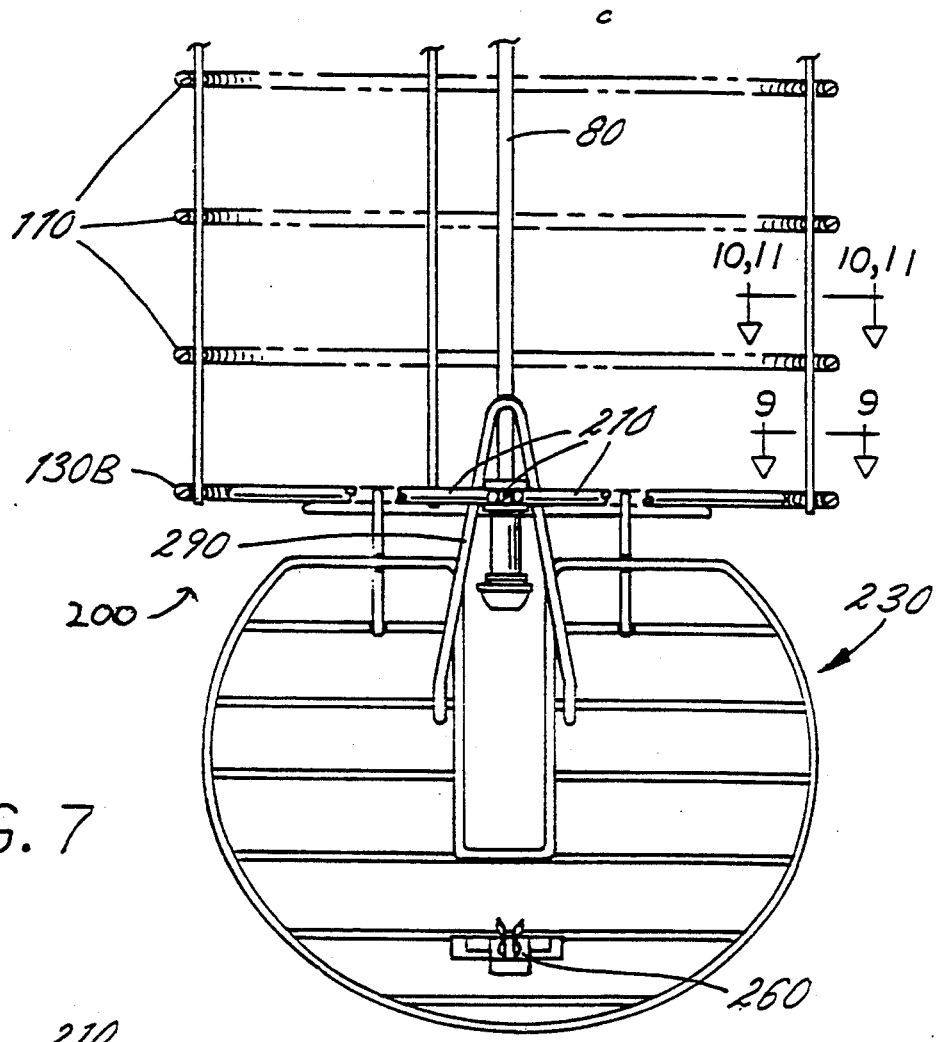
FIG. 7 is an enlarged, partial cross-sectional view of the tennis ball retriever substantially as seen along line 7—7 in FIG. 3, with the access door in an open position.

Preferably, the gate also includes a clearance channel 270 and a restraining strap 290, as illustrated in FIG. 7. This channel 270 allows for partial clearance of the drum support 70 when the gate is in the open position, as illustrated in FIG. 13. When the gate 230 includes such channel 270, the gate may be hingeably mounted to a pivot rod 280 attached to the outer tine 130B. In this embodiment, the pivot rod 280 allows the gate 230 to pivot about a pivot line that is a chord of the second circular face 200 having a length less than the diameter of the second circular face 200. In other words, the pivot line of the gate 230 is not a diameter of the circular face 200, and thus does not pass through the center of circular face 200.

As illustrated, the preferred structure allows the gate 230 to open further than it would be able to open if the gate were pivoted about a diameter of the circular face 200. This allows the user to easily access the collection drum 30 to remove the collected tennis balls. Preferably, the restraining strap 290 which is hingeably connected to a gate bar 250 prevents the gate 230 from opening completely. Additionally, when the gate 230 is in the open position, the gate engages the drum support 70, thus preventing rotation of the collection drum 30. This construction allows the user to prevent the handle 20 from rotating with respect to the collection drum 30 when the collection drum 30 is held in a stationary position to jettison the tennis balls. Thus, the user may pick up the tennis ball retriever 10 by grasping the gate 230 and a drum support 70. The collection drum 30 will then be firmly held within the user's grip, and the handle 20 will not rotate with respect to the collection drum 30.

The manner in which the tennis ball retriever 10 may be made is well known to those of ordinary skill in the art, and is not subject to any particular limitation. For example, the tines 110 may be produced from 0.25 inch threaded rods formed into a circle, as stated previously. The collection drum 30 may then be assembled by welding the various metal pieces together. Preferably, the handle 20 is formed separately, then attached to the hubs 100 by welding or any other suitable process. The collection drum 30, built in accordance with the preferred embodiment of the present invention, will hold approximately fifty tennis balls. When the collection drum 30 rests on a surface such as a tennis court, the tennis ball retriever 10 will have a total length from the handgrips to the ground of about forty-five inches.

The present invention also contemplates a method of retrieving tennis balls from a tennis court using a tennis ball retriever 10 according to the present invention. Pursuant to the inventive method, the user guides the tennis ball retriever 10 to a tennis ball TB. Preferably, this is accomplished by causing the collection drum 30 to roll as it is pushed with the aid of the handle 20. When the user has guided the tennis ball retriever to a tennis ball, he or she causes the collection drum to advance to a position in which the tennis ball is substantially centered between any two adjacent tines, as illustrated in FIG. 12. At this point, the user, by further advancing the collection drum, causes the tennis ball to be urged into the collection drum.

This method can be applied to a plurality of tennis balls simultaneously. Indeed, because the tennis ball need only be centered between any two adjacent tines, the user may retrieve up to (T-1) tennis balls simultaneously, wherein T is the total number of tines. For example, if the tennis ball retriever has four inner tines and a pair of outer tines for a total of six tines, the user may retrieve up to five tennis balls simultaneously.

The method of collecting tennis balls in accordance with the present invention is particularly enhanced when the abrasive surface of the tines comprises a plurality of grooves. In this embodiment, the grooves aid the user in advancing the tennis ball retriever to a position in which the tennis ball is centered between adjacent tines. As previously discussed, when the tennis ball is not in such a position, the grooves inhibit the tennis ball from moving away from the direction of advancement of the collection drum. Thus, the advancement of the collection drum drives the tennis ball into the position in which it is centered between adjacent tines.

The present invention thus overcomes the drawbacks associated with previously known tennis ball retrievers. A user may rapidly retrieve tennis balls from a tennis court using the present inventive tennis ball retriever. The tennis balls will not be pushed away by the tennis ball retriever, but rather will be urged into the collection drum. In addition, the user will not need to lift the tennis ball retrieving device until the collection drum has become full of tennis balls.

While particular embodiments of the invention have been shown, it will of course be understood that the invention is not limited thereto since modifications may be made by those skilled in the art, particularly in light of the foregoing teachings. It is, therefore, contemplated by the appended claims to cover any such modifications as incorporate those features which constitute the essential features of these improvements within the true spirit and scope of the invention. All references cited are herein incorporated by reference in their entireties.

What is claimed is:

1. A tennis ball retriever comprising, in combination, a handle having an operator gripping portion at one end, and a generally cylindrical collection drum rotatably journalled on the other end of said handle, said collection drum having a generally hollow interior and a plurality of circumferential tines axially spaced-apart by a dimension just less than the diameter of a tennis ball, each of said tines having a perimeter, at least one of said circumferential tines having an abrasive surface for engaging said tennis ball and urging it between an axially spaced-apart pair of said circumferential tines and into said hollow interior of said collection drum, wherein said abrasive surface comprises a plurality of grooves, wherein said grooves are disposed transversely along at least a portion of the perimeter of said tine.

2. A tennis ball retriever according to claim 1, wherein said plurality of tines comprises a pair of outer tines and at least one inner tine, the circumferential drum diameter of said pair of outer tines being larger than the circumferential drum diameter of said inner tine.

3. A tennis ball retriever according to claim 2, wherein said outer tines include a non-abrasive surface.

4. A tennis ball retriever according to claim 3, wherein said non-abrasive surface comprises a tire.

5. A tennis ball retriever according to claim 1, wherein said plurality of tines comprises a pair of outer tines and a plurality of inner tines and wherein each of said inner tines includes said abrasive surface.

6. A tennis ball retriever according to claim 1, wherein said collection drum has first and second circular end faces and wherein said first end face includes a gate hingeably mounted thereto.

7. A tennis ball retriever according to claim 6, wherein said gate is hingeably moveable between an open position and a closed position and wherein said gate engages said handle when said gate is in the open position.

8. A tennis ball retriever according to claim 6, wherein said gate includes a restraining strap.

9. A method of enabling a user to retrieve a tennis ball from a tennis court, said method comprising grasping a tennis ball retriever, said tennis ball retriever having a handle, a generally cylindrical collection drum rotatably journalled on one end of the handle and said collection drum having a generally hollow interior defined by a plurality of circumferential tines axially spaced-apart by a dimension just less than the diameter of a tennis ball, each of said tines having a perimeter, at least one of tines having an abrasive surface comprising a plurality of grooves, wherein said grooves are disposed transversely along at least a portion of the perimeter of said tine, guiding the tennis ball retriever to the tennis ball, causing said collection drum to rotate and advance to a position in which the tennis ball is substantially centered between any two adjacent tines and wherein said tennis ball is gripped by a plurality of said grooves, and thereafter causing the tennis ball to be urged into the collection drum by further advancing the tennis ball retriever.

10. A method according to claim 9, wherein said method is applied to a first tennis ball, wherein said method is subsequently applied to a second tennis ball.

11. A method of enabling a user to retrieve a tennis ball from a tennis court, said method comprising:

grasping a tennis ball retriever, said tennis ball retriever having a handle, a generally cylindrical collection drum rotatably journalled on one end of the handle and said collection drum having a generally hollow interior defined by a plurality of circumferential tines axially spaced-apart by a dimension just less than the diameter of a tennis ball, each of said tines having a perimeter, wherein said plurality of circumferential tines comprises a pair of outer tines and a plurality of inner tines, wherein each of said plurality of inner tines includes an abrasive surface comprising a plurality of grooves, wherein said grooves are disposed transversely along at least a portion of the perimeter of said tine;

guiding the tennis ball retriever to the tennis ball;

causing said collection drum to rotate and advance to a position in which the tennis ball is substantially centered between any two adjacent tines and wherein said tennis ball is gripped by a plurality of said grooves; and thereafter causing the tennis ball to be urged into the collection drum by further advancing the tennis ball retriever.

12. A method of enabling a user to retrieve a tennis ball from a tennis court, said method comprising:

grasping a tennis ball retriever, said tennis ball retriever having a handle, a generally cylindrical collection drum rotatably journalled on one end of the handle and said collection drum having a generally hollow interior defined by a plurality of circumferential tines axially spaced-apart by a dimension just less than the diameter of a tennis ball, each of said tines having a perimeter, wherein at least one of said tines includes an abrasive surface comprising a plurality of grooves, wherein said grooves are disposed transversely along at least a portion of the perimeter of said tine, wherein said collection drum has first and second circular end faces and wherein said first end face includes a gate hingeably mounted thereto;

guiding the tennis ball retriever to the tennis ball;

causing said collection drum to rotate and advance to a position in which the tennis ball is substantially centered between any two adjacent tines and wherein said tennis ball is gripped by a plurality of said grooves; and thereafter causing the tennis ball to be urged into the collection drum by further advancing the tennis ball retriever.

* * * * *

UNITED STATES PATENT AND TRADEMARK OFFICE

CERTIFICATE OF CORRECTION

PATENT NO. : 5,407,242

DATED : APRIL 18, 1995

INVENTOR(S) : KURT G. BERANEK

It is certified that error appears in the above-indentified patent and that said Letters Patent is hereby corrected as shown below:

ON THE TITLE PAGE:

[56] References Cited

FOREIGN PATENT DOCUMENTS

Second column, line 3, "1388 of 1903 United Kingdom" should read -- 1388 1/1903 United Kingdom --.

Signed and Sealed this

Twenty-seventh Day of June, 1995

*Attest:*

*Attesting Officer*

Bruce Lehman

BRUCE LEHMAN

*Commissioner of Patents and Trademarks*